US007722031B2

(12) United States Patent
Fujiwara et al.

(10) Patent No.: US 7,722,031 B2
(45) Date of Patent: May 25, 2010

(54) IMAGE FORMING APPARATUS INCLUDING A SHEET FEED CASSETTE CAPABLE OF EFFECTIVELY TRANSPORTING A SHEET RECORDING MEDIUM

(75) Inventors: Hidehiko Fujiwara, Tokyo (JP); Mitsuru Yamada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 303 days.

(21) Appl. No.: 11/675,311

(22) Filed: Feb. 15, 2007

(65) Prior Publication Data

US 2008/0012208 A1 Jan. 17, 2008

(30) Foreign Application Priority Data

Feb. 15, 2006 (JP) ..... 2006-038139

(51) Int. Cl.
*B65H 1/00* (2006.01)

(52) U.S. Cl. ..... 271/145

(58) Field of Classification Search ..... 271/145, 271/162; 399/393, 377
See application file for complete search history.

(56) References Cited

U.S. PATENT DOCUMENTS 5,084,728 A * 1/1992 Horikiri et al. ..... 355/72
5,687,965 A * 11/1997 Matsuda et al. ..... 271/241
5,829,898 A * 11/1998 Hill et al. ..... 400/624
6,164,643 A * 12/2000 Otsuka ..... 271/250
7,163,286 B2 * 1/2007 Shiraiwa et al. ..... 347/104
2002/0036375 A1 * 3/2002 Matsuda ..... 271/3.14
2008/0111296 A1 * 5/2008 Takahashi ..... 271/225

FOREIGN PATENT DOCUMENTS

| | | |
|---|---|---|
| CN | 1255656 A | 6/2000 |
| CN | 1702026 A | 11/2005 |
| JP | 62-181166 | 8/1987 |
| JP | 10-129884 | 5/1998 |
| JP | 2002-068546 | 3/2002 |
| JP | 2002-179306 | 6/2002 |
| JP | 2003-212360 | 7/2003 |
| JP | 2004-226824 | 8/2004 |

OTHER PUBLICATIONS

U.S. Appl. No. 12/169,217, filed Jul. 8, 2008, Yamada, et al.

* cited by examiner

*Primary Examiner*—Patrick H Mackey
*Assistant Examiner*—Ernesto Suarez
(74) *Attorney, Agent, or Firm*—Oblon, Spivak, McCelland, Maier & Neustadt, L.L.P.

(57) ABSTRACT

An image forming apparatus includes a sheet feed cassette for storing a sheet. The sheet feed cassette includes a protective sheet which is provided on a portion of the sheet feed cassette that contacts the sheet so as to prevent adhesive material from sticking thereto. The image forming apparatus further includes a sheet conveyance path that transports a sheet, and a protective sheet provided on a portion of the sheet conveyance path that contacts the sheet so as to prevent an adhesive material from sticking thereto.

8 Claims, 6 Drawing Sheets

IMAGE FORMING APPARATUS INCLUDING A SHEET FEED CASSETTE CAPABLE OF EFFECTIVELY TRANSPORTING A SHEET RECORDING MEDIUM

CROSS REFERENCE TO RELATED APPLICATIONS

This patent specification is based on and claims priority under 35 U.S.C. §119 from Japanese patent application No. JP2006-038139, filed on Feb. 15, 2006, in the Japan Patent Office, the entire contents of which are incorporated herein by reference.

BACKGROUND OF THE INVENTION

1. Field of the Invention

Exemplary aspects of the present invention generally relate to a sheet feed cassette and an image forming apparatus including the same, and more particularly to a sheet feed cassette capable of effectively transporting a sheet recording medium, and an image forming apparatus including the same.

2. Discussion of the Background

Image forming apparatuses such as a copier, a printer, a facsimile, a multi-functional printer and so forth are equipped with a sheet feed cassette (a sheet feed cassette as used herein includes a sheet feed tray and a cassette does not require removability from the image forming apparatus, although this may be possible). The sheet feed cassette is attachable and detachable relative to the image forming apparatus and stores paper. Paper, as used herein, includes a sheet, transfer member, printable media and the like. Typically, but not necessarily, paper is the medium of the sheet on which an image is to be formed. It should be understood, however, that the sheets, etc., are not limited only to paper.

In the image forming apparatus, i.e., a multi-functional copier, sheet feed rollers or the like separate the stored paper one sheet at a time and transport the sheets to an image forming portion. In the image forming portion, a toner image is transferred on the paper. The paper carrying the toner image is transported to a fixing unit so that the toner image is fixed. Ultimately, the paper is ejected to a catch tray. The sheet feed cassette includes side frames which regulate the alignment of the paper in a width direction perpendicular to a sheet conveyance direction. The cassette further includes an end frame which regulates the paper in a front-rear direction of the sheet conveyance direction, and a bottom plate urged in an upward direction by a biasing mechanism.

In such image forming apparatuses, a release coated paper which contains an adhesive material may be used. When such a paper is transported, the adhesive material may leak out of an end portion of the paper or a cut, and may stick to the sheet conveyance path and a storage surface of the sheet feed cassette. Along with the sheet transporting operation, the adhesive material continues to stick causing the sheet conveyance path to become contaminated with adhesive. Consequently, problems such as an interruption during transportation of the paper, paper jams and skew may occur.

When the adhesive material sticks to the side frames and/or the end frame of the sheet feed cassette which may be in close contact with the paper, the paper may be adhered to the side frames and/or the end frame generating the similar problems described above, because the end portion of the paper is pressed. Similar problems described above may be generated in a case where the adhesive material sticks to the bottom plate of the sheet feed cassette. In this case, since the laden weight of the paper is applied on the bottom plate, the paper may easily adhere to the bottom plate.

SUMMARY OF THE INVENTION

In view of the foregoing, exemplary embodiments of the present invention provide an image forming apparatus having a sheet feed cassette that includes a protective sheet provided on or around the frame so as to prevent an adhesive material from sticking thereto.

In one exemplary embodiment of the above-mentioned sheet feed cassette, the protective sheet may be attachably and detachably provided.

In one exemplary embodiment of the above-mentioned sheet feed cassette, a front surface of the protective sheet may be formed of fluoroplastic.

In one exemplary embodiment of the above-mentioned sheet feed cassette, the protective sheet may include a plurality of the protective sheets, and the plurality of protective sheets may be replaceably overlaid on one another.

In one exemplary embodiment of the above-mentioned sheet feed cassette, the protective sheet may include a rear surface having an adhesive material so that the protective sheet may be affixed to the portion of the sheet feed cassette that contacts the sheet.

In one exemplary embodiment of the above-mentioned sheet feed cassette, the protective sheet may include a tab from which the protective sheet may be peeled off from the portion of the sheet feed cassette that contacts the sheet, and no adhesive material may be provided on a rear surface of the tab.

In one exemplary embodiment of the above-mentioned sheet feed cassette, the protective sheet may include a tab from which the protective sheet may be peeled off from the portion of the sheet feed cassette that contacts the sheet, and a sheet piece having no adhesive material may be affixed on the rear surface of the tab.

In one exemplary embodiment of the above-mentioned sheet feed cassette, the portion of the sheet feed cassette that contacts the sheet may include a side frame.

In one exemplary embodiment of the above-mentioned sheet feed cassette, the portion of the sheet feed cassette that contacts the sheet may include a bottom plate.

At least one embodiment of the present invention provides an image forming apparatus that may include a sheet conveyance path that transports a sheet, and a protective sheet provided on a portion of the sheet conveyance that contacts the sheet so as to prevent an adhesive material from sticking thereto.

The above-mentioned image forming apparatus may further include a protective sheet storage unit for storing the protective sheet for replacement.

The above-mentioned image forming apparatus may further include a storage area for storing a used protective sheet.

Additional features and advantages of the present invention will be more fully apparent from the following detailed description of exemplary embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of exemplary embodiments when considered in connection with the accompanying drawings, wherein.

DETAILED DESCRIPTION OF EXEMPLARY EMBODIMENTS

Figure 1:
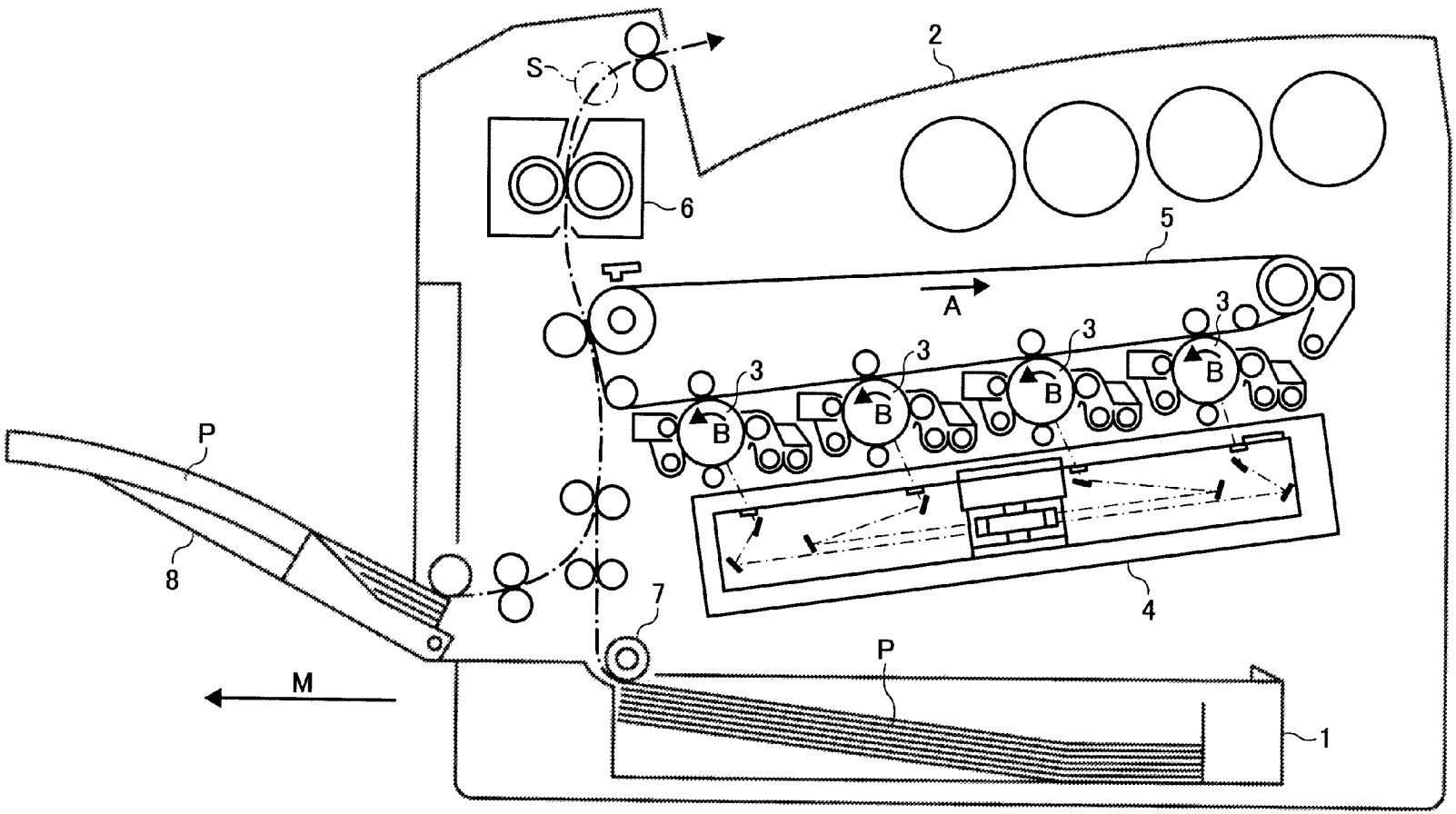
FIG. 1 is a schematic diagram illustrating an example laser printer as an image forming apparatus according to one exemplary embodiment of a present invention.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. For the sake of simplicity of drawings and descriptions, the same reference numerals are given to materials and constituent parts having the same functions, and descriptions thereof will be omitted unless otherwise stated.

Exemplary embodiments of the present invention are now explained below with reference to the accompanying drawings. In the later described comparative example, exemplary embodiment, and alternative example, the same reference numerals will be given to constituent elements such as parts and materials having the same functions, and the descriptions thereof will be omitted.

Referring now to the drawings, wherein like reference numerals designate identical or corresponding parts throughout the several views, particularly to FIG. 1, a structure of a laser printer as an image forming apparatus according to an exemplary embodiment of the present invention is described.

One exemplary embodiment of the present invention will be explained below with reference to FIGS. 1 through 9. With reference to FIG. 1, a description will now be given of an exemplary structure of a laser printer as an image forming apparatus according to one exemplary embodiment. The image forming apparatus includes a sheet feed cassette 1 attachably and detachably disposed at a bottom end portion of the image forming apparatus.

Paper or a recording sheet P which is printed within the image forming apparatus is ejected and stacked on a catch tray 2 formed on an upper surface of the apparatus main body. Paper, as used herein, includes a sheet, transfer member, printable media and the like. Typically, but not necessarily, paper is the medium of the sheet on which an image is to be formed. For simplicity, this Detailed Description section refers to paper, sheets thereof, paper feeder, etc. It should be understood, however, that the sheets, etc., are not limited only to paper.

Devices associated with image formation are installed in the apparatus main body. Such devices include: drum-type photoreceptors 3 of different colors of yellow (Y), magenta (M), cyan (C) and black (BK), each rotates in an arrow B direction, electrophotographic process members, an optical writing unit 4, an intermediate transfer belt 5 which rotates in an arrow A direction, a fixing unit 6 and so forth associated with image formation.

The electrophotographic process members are disposed around the photoreceptors 3. The optical writing unit 4 irradiates a laser beam for forming an electrostatic latent image. While a single polygonal mirror has been illustrated, two, three, four, or any desired number of polygonal mirrors may be utilized. The intermediate transfer belt 5 transfers toner images of different colors formed on the respective photoreceptors 3 to the recording sheet P. The fixing unit 6 performs fixing processing with respect to the recording sheet P on which the toner images are transferred.

A sheet feed/conveyance path of the recording sheet P relative to the intermediate transfer belt 5 is configured in a substantially vertical direction at a front side of the apparatus main body. The sheet feed cassette 1, which feeds the recording sheet P to the sheet feed/conveyance path using the sheet feed roller 7 or the like, is disposed at the very bottom position of the apparatus main body and is drawable in a frontward direction shown by an arrow M. Alternatively, the tray can be removed and inserted from either side, or even the rear, if desired. Moreover, the tray/cassette may be fixed or non-removable.

The recording sheet P loaded on the sheet feed cassette 1 is fed by the sheet feed roller 7 and is ejected onto the catch tray 2 after passing through the sheet feed/conveyance path as shown by a dotted line in FIG. 1. The image forming apparatus further includes a manual feed tray 8 as shown in FIG. 1.

Figure 2:
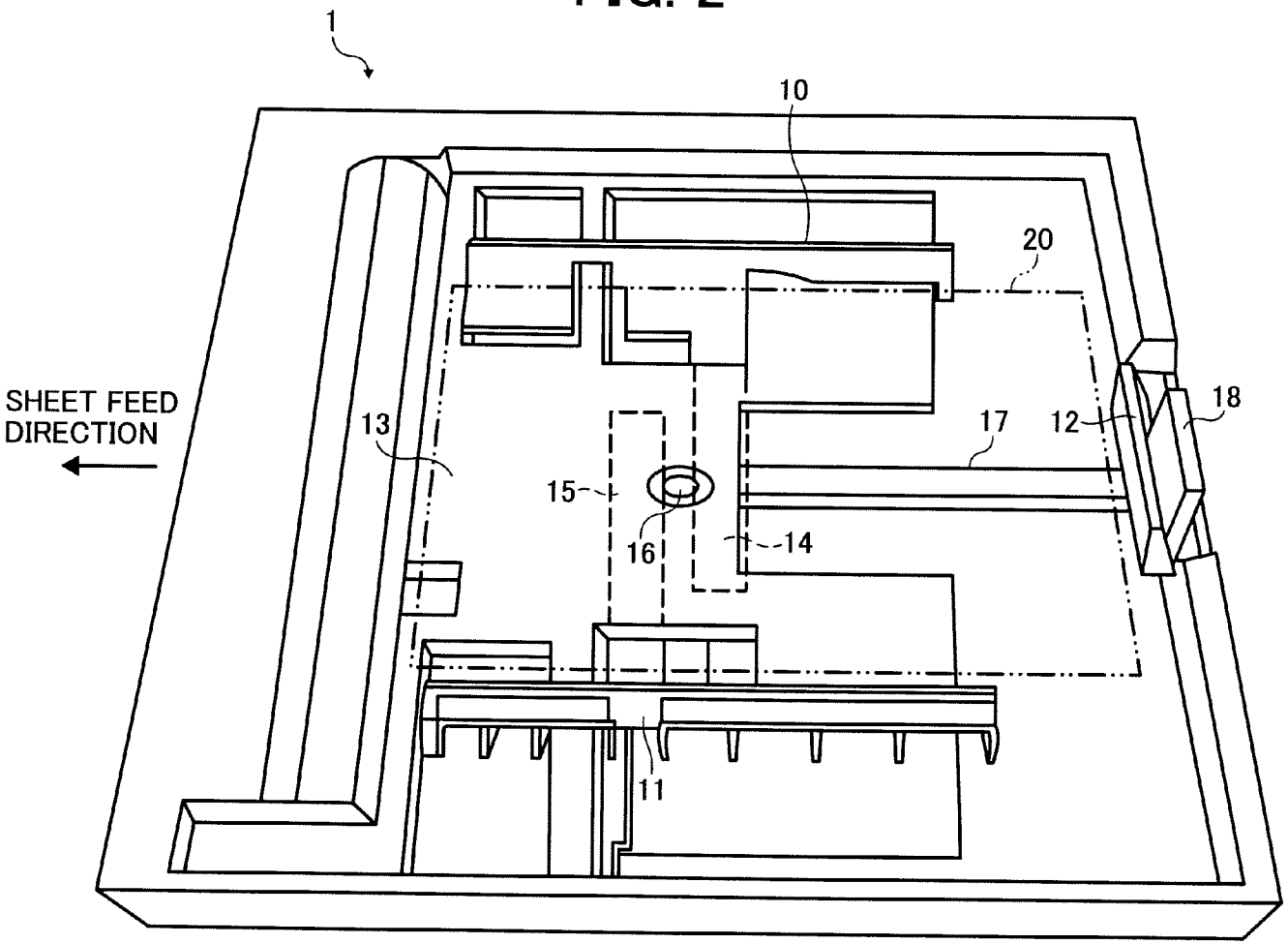
FIG. 2 is a perspective view illustrating a sheet feed cassette.

As shown in FIG. 2, the sheet feed cassette 1 includes a pair of side frames 10 and 11, an end frame 12, a bottom plate 13 and so forth. The side frames 10 and 11 are each disposed on the bottom plate 13 and integrally include rack portions 14 and 15 which extend in the sheet width direction perpendicular to the sheet feed direction shown by an arrow. The rack portions 14 and 15 fit with a single pinion 16 so as to be able to synchronously adjust the alignment of the paper in the paper width direction. The end frame 12 is movable in the sheet feed direction along a rail 17 and is allowed to be positioned at a given position by a stopper 18.

Figure 3:
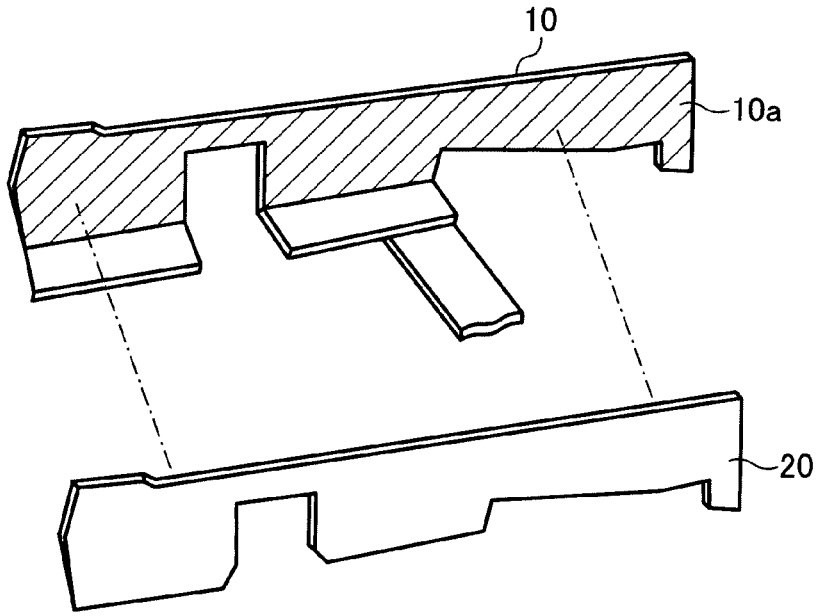
FIG. 3 is an exploded perspective view illustrating a manner in which a protective sheet is affixed relative to a side frame.

As shown in FIG. 3, a protective sheet 20 having a similar or the same shape as that of the inner surface of a vertical wall 10*a* is affixed on an inner surface of a vertical wall 10*a* of the side frame 10 on the left side shown by hatching. The protective sheet 20 may be used for preventing an adhesive material from sticking to the vertical wall 10*a*.

Figure 4:
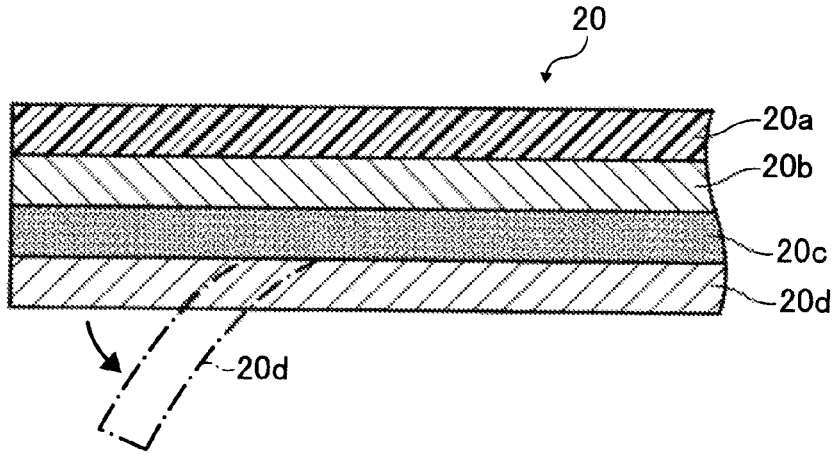
FIG. 4 is a cross-sectional view illustrating the protective sheet of FIG. 3.

As shown in FIG. 4, according to an exemplary embodiment, the protective sheet 20 is formed of a surface layer or a parting layer 20*a* of fluoroplastic, a supporting layer 20*b* which may be chartaceous, an adhesive layer 20*c*, and a release coated paper or tape 20*d*. The adhesive layer 20*c* of the protective sheet 20 is affixed on the inner surface of the vertical wall 10*a*, by first peeling off the release coated paper (protective tape) 20*d* and then pressing the protective sheet 20 against the vertical wall 10*a*.

Though not shown, similar to the side frame 10 as described above, on the inner surface of the vertical wall of the side frame 11 on the right side and on the inner surface of the end frame 12 is affixed the protective sheet 20 having a size which corresponds to the size of the respective inner surfaces.

On the front surface of the bottom plate 13 is affixed the protective sheet 20 having a dimension indicated by a double-dotted line as shown in FIG. 2. When affixing the protective sheet 20 corresponding to the bottom plate 13, the protective sheet 20 is placed on the bottom plate 13 in a state where the release coated paper 20*d* is not peeled off.

The side frames 10 and 11, and the end frame 12 are positioned in accordance with the protective sheet 20, and subsequently the release coated paper 20*d* of the protective sheet 20 is peeled off so as to affix the protective sheet 20. In a case where the recording sheets of different sizes are used, the size of the protective sheet 20 is configured to correspond to the paper of the smallest size.

The dimension of the adhesive layer 20*c* on the rear surface of the protective sheet 20 does not have to cover the entire surface thereof. The adhesive layer 20*c* may have a narrow width. In such a case, the release coated paper 20*d* may have a tape-like shape. In a case where the release coated paper 20*d* has the tape-like shape, the peeling area becomes less so that the protective sheet 20 may be easily and quickly affixed.

When the recording sheets P are loaded in the sheet feed cassette 1, the side frames 10 and 11, the end frame 12, and the bottom plate 13 may be the areas or the surfaces with which the recording sheets P contact. Thus, in a case where the paper such as the release coated paper containing an adhesive material is used, there may be a problem in which the adhesive material leaks out of the end portion of the paper or a cut, and sticks to the surfaces of the side frames 10 and 11, the end frame 12 and the bottom plate 13.

However, when the protective sheet 20 is affixed on the places with which the paper may come into contact as described in the exemplary embodiment, it may be possible to prevent the adhesive material from sticking. The parting layer 20*a* that constitutes the front surface of the protective sheet 20 is not limited to fluoroplastic, and may be of other materials which prevent the adhesive material from sticking.

According to one exemplary embodiment, the protective sheet 20 is affixed on the portion of the sheet feed cassette, i.e., the side frames 10 and 11, the end frame 12, and the bottom plate 13, that contacts the sheet. Thereby, it may be possible to prevent the adhesive material from sticking. Alternatively, the protective sheet 20 may be affixed only on the side frames 10 and 11. Furthermore, the similar effects may be attained when the protective sheet 20 may be affixed only to a portion of the side frames 10 and 11.

It may be possible that the protective sheet 20 may be contaminated over time so that the adhesive material may stick thereon through contamination. Consequently, the function of the protective sheet 20 for preventing the adhesive material from sticking may be deteriorated. In such a case, it may be necessary to change or replace the protective sheet 20.

Figure 5:
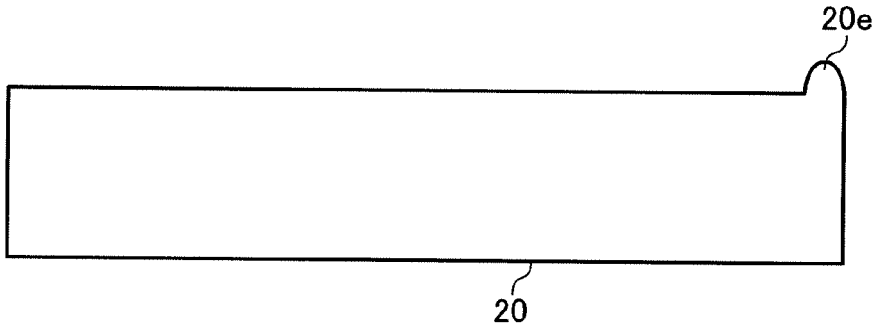
FIG. 5 is a front view illustrating the protective sheet including a tab.

In order to facilitate the replacement, as shown in FIG. 5, for example, a tab 20*e* as a protruding portion may be formed at an end portion of the protective sheet 20 so that the tab 20*e* may serve as the point of peeling from where the protective sheet 20 may be peeled. In this case, the adhesive layer 20*c* is not provided on the rear surface of the tab 20*e*. Thus, the tab 20*e* is an adhesiveless surface. When replacing the protective sheet 20, the adhesion of the adhesive layer 20*c* of the protective sheet 20 is configured such that the protective sheet 20 may be peeled off at ease.

Figure 6:
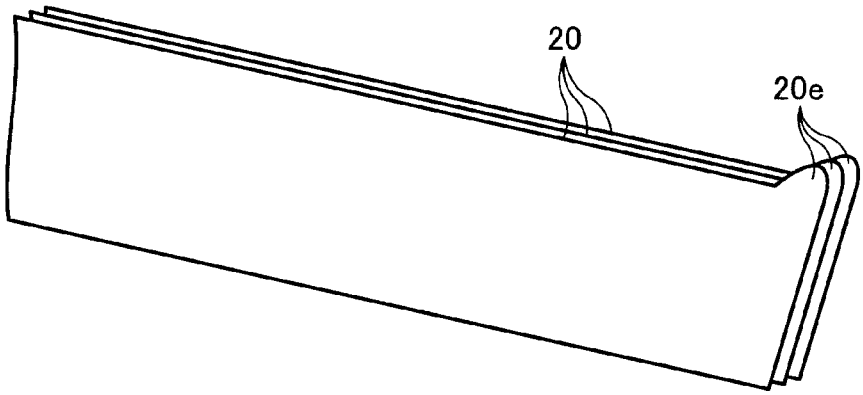
FIG. 6 is a perspective view illustrating a manner in which a plurality of the protective sheets including the tab are overlaid on one another.

As shown in FIG. 6, a plurality of the protective sheets 20 may be overlaid on one another. Accordingly, when the protective sheet 20 is contaminated, the contaminated protective sheet 20 may be peeled off one sheet at a time so that a new state, that is, a clean state is recovered. The same may be said when a material with less parting capability is used on the front surface. In other words, when the adhesive material sticks to the protective sheet 20, the contaminated protective sheet 20 may be peeled off one sheet at a time so that a new state is recovered.

Figure 7:
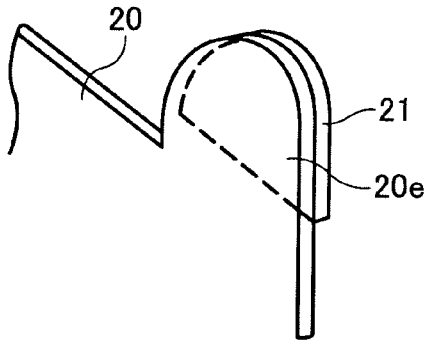
FIG. 7 is a perspective view illustrating one variation of the tab of FIG. 6.

In order not to provide adhesion on the rear surface of the tab 20*e*, as shown in FIG. 7, a sheet piece 21, which may be of a piece of paper, may be affixed on the rear surface of the tab 20*e* in a state where the adhesive layer 20*c* is provided on the entire rear surface of the protective sheet 20 including the rear surface of the tab 20*e*.

Figure 8:
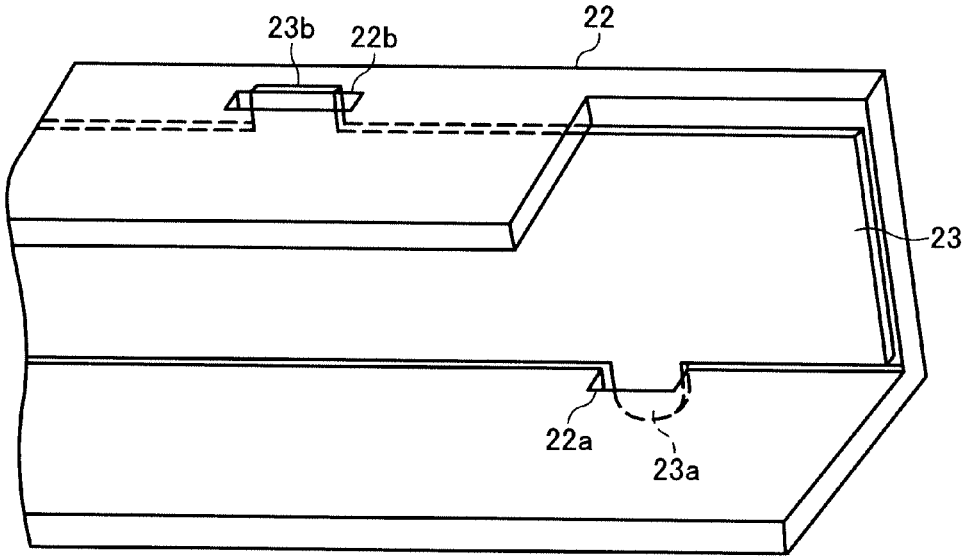
FIG. 8 is a perspective view illustrating a manner in which another variation of the protective sheet is disposed.

As shown in FIG. 8, notch portions 22*a* and 22*b* may be provided on a side frame 22. A protective sheet 23 may be disposed on the side frame 22. The protective sheet 23 may include fitting tabs 23*a* and 23*b* which are provided in a protruding manner and are fitted with the notch portions 22*a* and 22*b*. The protective sheet 23 does not include an adhesive layer, and is positioned simply by the fitting tabs 23*a* and 23*b*, thereby making it easy to replace. Such a method in which no adhesive layer is provided to the protective sheet 23 may similarly be applied to the end frame 12 and the bottom plate 13.

Figure 9:
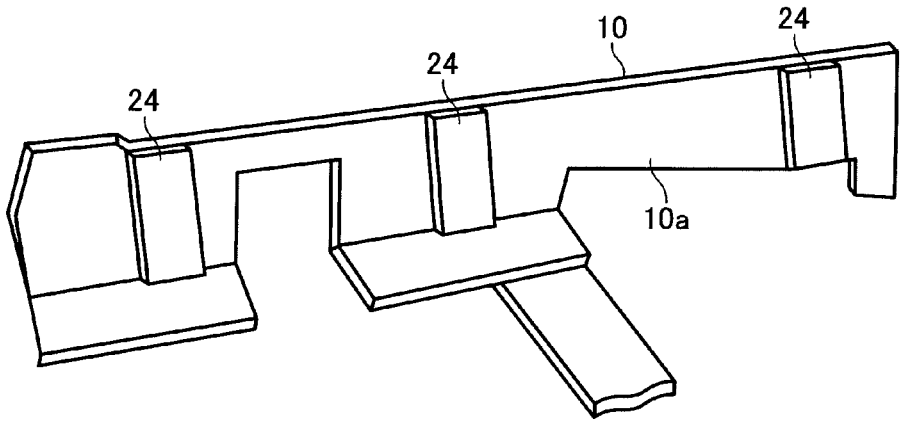
FIG. 9 is a perspective view illustrating a manner in which another variation of the protective sheet is disposed.

The adhesion protecting function which prevents the adhesive material from sticking may still be attained without having the protective sheet affixed on the entire surfaces of the side frames or the like. For example, as shown in FIG. 9, when a plurality of the protective sheets 24 having a small dimension are affixed partially on the inner surface of the vertical wall 10*a* of the side frame 10, the end portion of the paper comes into contact with only the protective sheets 24, and the area of the paper relative to the surface without the protective sheets 24 is in a non-contact state.

The protective sheets 24 having a small dimension is easy to affix and to handle, while achieving the same adhesion protecting function, which prevents the adhesive material from sticking, similarly to the case in which the protective sheet is affixed on the entire surface.

Figure 10A:
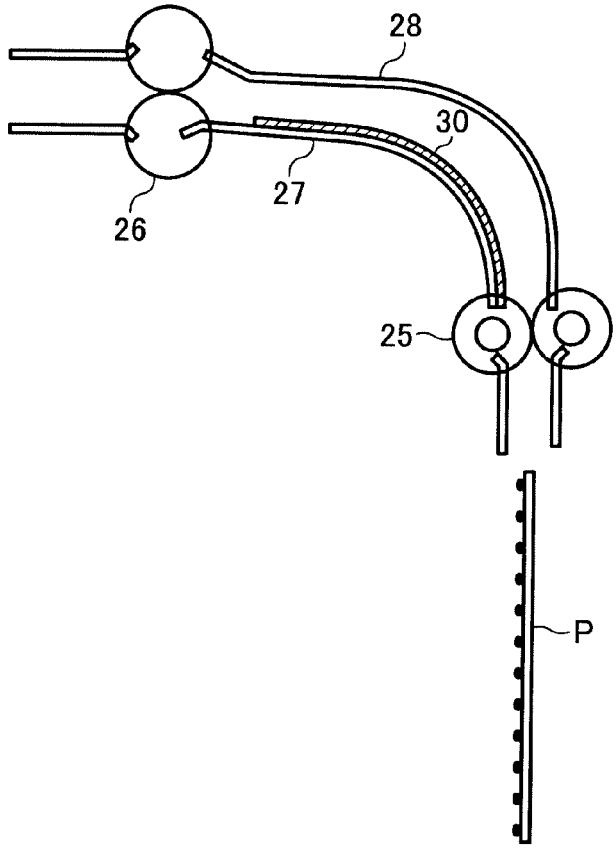
FIG. 10A is a cross-sectional view illustrating a manner in which a protective sheet according to another exemplary embodiment of the present invention is disposed.
Figure 10B:
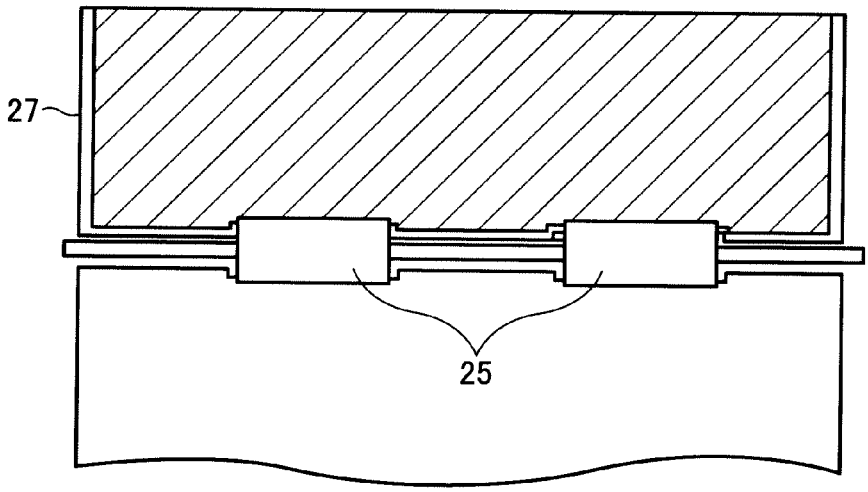
FIG. 10B is a side view illustrating a manner in which the protective sheet of FIG. 10A is disposed.

Reference is now made to FIGS. 10A and 10B to illustrate another exemplary embodiment. In the one exemplary embodiment described above, exemplary aspects to prevent the adhesive material from sticking to the sheet feed cassette 1 are provided. A similar problem as discussed above may occur in a conveyance path in an image forming apparatus when a recording sheet that contains an adhesive material is transported.

In another exemplary embodiment, ways in which the problem may be reduced or even eliminated are addressed. As shown in FIG. 1, the paper may be rubbed against the conveyance path, especially against an area S indicated by a dotted circle where the sheet conveyance path is curved. Consequently, the adhesive material may easily stick to the area S.

In FIG. 10A, reference numerals 25 and 26 indicate a pair of conveyance rollers. A reference numeral 27 indicates a lower guide plate, and 28 indicates an upper guide plate. On an inner surface of the lower guide plate 27, a protective sheet 30 having a similar structure as that of the protective sheet 20 described above is attachably and detachably affixed along a curved surface. The protective sheet 30 may include a plurality of protective sheets which are overlaid on one another.

The protective sheet 30 may be formed of a surface layer or a parting layer of fluoroplastic, a supporting layer which may be chartaceous, an adhesive layer, and a release coated paper or tape. The adhesive layer of the protective sheet is affixed on the inner surface of the lower guide plate 27, by first peeling off the release coated paper (protective tape), and then pressing the protective sheet against lower guide plate 27.

A tab, which is similar to the tab 20*e* as a protruding portion described above, may be formed at an end portion of the protective sheet 30 so that the tab may serve as the point of peeling from where the protective sheet 30 may be peeled.

A sheet piece, which is similar to the sheet piece 21 as described above, may be affixed on the rear surface of the tab in a state where the adhesive layer is provided on the entire rear surface of the protective sheet 30 including the rear surface of the table.

FIG. 10B is a side view of the paper path of FIG. 10A. Using the arrangement of FIGS. 10A and 10B, it may be possible to prevent the adhesive material from sticking on the inner surface of the lower guide plate 27. Furthermore, an optimal conveyance state in the image forming apparatus may be maintained for an extended period of time.

It may be possible to provide a replacement protective sheet storage unit which stores the protective sheet for replacement so that the protective sheet may easily and quickly be replaced. The replacement protective sheet storage unit may be provided, for example, inside the front cover of the image forming apparatus in a pocket-like manner.

Furthermore, it may be possible to provide a waste protective sheet storage unit which stores a used protective sheet so that processing after replacement may easily and quickly be performed. The waste protective sheet storage unit may be provided, for example, integrally to a waste toner tank in the image forming apparatus in a pocket-like manner. Accordingly, the waste products may be stored in a concentrated manner.

One or more embodiments of the present invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. One or more embodiments of the present invention may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Further, any of the aforementioned methods may be embodied in the form of a program. The program may be stored on a computer readable media and is adapted to perform any one of the aforementioned methods, when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks, cassette tapes, and removable hard disks; media with a built-in rewriteable non-volatile memory, such as memory cards; and media with a built-in ROM, such as ROM cassettes.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A sheet feed cassette for storing a sheet, comprising:

an upper surface including a first notch;

a lower surface including a second notch;

a side surface between the upper and lower surfaces which is perpendicular to a bottom of the sheet feed cassette;

a protective sheet provided parallel to and against the side surface of the sheet feed cassette that contacts the sheet which is stored so as to prevent adhesive material from the sheet which is stored from sticking to the sheet feed cassette, the protective sheet including tabs which are inserted into the notch of the upper surface and the notch of the lower surface.

2. The sheet feed cassette according to claim 1, wherein the protective sheet is attachably and detachably connected to the sheet feed cassette.

3. The sheet feed cassette according to claim 1, wherein a front surface of the protective sheet is formed of fluoroplastic.

4. The sheet feed cassette according to claim 1, wherein the protective sheet includes a plurality of protective sheets, and the plurality of protective sheets are replaceably overlaid on one another.

5. The sheet feed cassette according to claim 1, wherein the protective sheet includes a rear surface having no adhesive material to affix the protective sheet to the side surface.

6. The sheet feed cassette according to claim 1, wherein the portion of the sheet feed cassette that contacts the sheet which is stored includes a side frame which includes the upper surface, the lower surface, and the side surface.

7. The sheet feed cassette according to claim 1, wherein the portion of the sheet feed cassette that contacts the sheet which is stored includes a bottom plate.

8. The sheet feed cassette according to claim 1, further comprising:

the sheet which is stored.

* * * * *